US011178907B2

(12) United States Patent
Jordil et al.

(10) Patent No.: US 11,178,907 B2
(45) Date of Patent: Nov. 23, 2021

(54) SMOKING ARTICLE HAVING A FILTER INCLUDING A CAPSULE

(71) Applicant: PHILIP MORRIS PRODUCTS S.A., Neuchatel (CH)

(72) Inventors: Yves Jordil, Lausanne (CH); Charles Kuersteiner, Jouxtens-Mezery (CH)

(73) Assignee: Philip Morris Products S.A., Neuchatel (CH)

( * ) Notice: Subject to any disclaimer, the term of this patent is extended or adjusted under 35 U.S.C. 154(b) by 218 days.

(21) Appl. No.: 15/100,392

(22) PCT Filed: Dec. 18, 2014

(86) PCT No.: PCT/EP2014/078454

§ 371 (c)(1),
(2) Date: May 31, 2016

(87) PCT Pub. No.: WO2015/091792

PCT Pub. Date: Jun. 25, 2015

(65) Prior Publication Data

US 2016/0295914 A1 Oct. 13, 2016
US 2017/0164652 A9 Jun. 15, 2017

(30) Foreign Application Priority Data

Dec. 20, 2013 (EP) ..... 13198919

(51) Int. Cl.
*A24D 3/06* (2006.01)
*A24D 3/04* (2006.01)
(Continued)

(52) U.S. Cl.
CPC ..... *A24D 3/061* (2013.01); *A24B 15/283* (2013.01); *A24D 3/048* (2013.01); *A24D 3/066* (2013.01); *A24D 3/10* (2013.01); *A24D 3/163* (2013.01)

(58) Field of Classification Search
CPC ..... A24D 3/048; A24D 3/061
See application file for complete search history.

(56) References Cited

U.S. PATENT DOCUMENTS 3,366,121 A 12/1964 Carty
3,390,686 A 12/1965 Irby, Jr.
(Continued)

FOREIGN PATENT DOCUMENTS

CN 1458396 11/2003
CN 1630475 6/2005
(Continued)

OTHER PUBLICATIONS

Mesh Size; https://www.sigmaaldrich.com/chemistry/stockroom-reagents/learning-center/technical-library/particle-size-conversion.html (Year: 2010).*

(Continued)

*Primary Examiner* — Eric Yaary
(74) *Attorney, Agent, or Firm* — Mueting Raasch Group

(57) ABSTRACT

There is provided a smoking article having an aerosol generating substrate and a mouthpiece. The mouthpiece includes a cavity at least partially filled with a particulate material, such as activated carbon,and contains at least one breakable capsule of a liquid flavourant at least partially surrounded by the particulate material, such that the force required to break the capsule within the mouthpiece to release the liquid flavourant is less than three times the inherent burst strength of the capsule.

14 Claims, 1 Drawing Sheet

(51) Int. Cl.

| | |
|---|---|
| ***A24D 3/10*** | (2006.01) |
| ***A24D 3/16*** | (2006.01) |
| ***A24B 15/28*** | (2006.01) |

(56) References Cited

U.S. PATENT DOCUMENTS

| | | | | |
|---|---|---|---|---|
| 3,550,508 | A | 12/1970 | Iman | |
| 3,685,521 | A | 8/1972 | Dock | |
| 4,889,144 | A * | 12/1989 | Tateno | A24D 3/061 131/337 |
| 5,056,537 | A * | 10/1991 | Brown | A24B 15/12 131/297 |
| 6,013,593 | A | 1/2000 | Lee | |
| 7,179,382 | B2 | 2/2007 | Hiltzik | |
| 7,784,470 | B2 | 8/2010 | Paine, III | |
| 8,118,155 | B2 | 2/2012 | Noda | |
| 8,671,951 | B2 | 3/2014 | Ercelebi | |
| 8,739,802 | B2 | 6/2014 | Fagg | |
| 8,820,331 | B2 | 9/2014 | Hartmann | |
| 9,066,541 | B2 | 6/2015 | Allen | |
| 9,486,011 | B2 | 11/2016 | Chida | |
| 2006/0180164 | A1* | 8/2006 | Paine, III | A24D 3/163 131/202 |
| 2008/0017206 | A1* | 1/2008 | Becker | A24B 15/282 131/276 |
| 2008/0142028 | A1* | 6/2008 | Fagg | A24D 3/061 131/361 |
| 2008/0163877 | A1* | 7/2008 | Zhuang | A24D 3/061 131/71 |
| 2009/0050163 | A1* | 2/2009 | Hartmann | A24D 3/048 131/200 |
| 2010/0319717 | A1* | 12/2010 | Chida | A24D 3/14 131/332 |
| 2011/0271968 | A1* | 11/2011 | Carpenter | A24D 3/048 131/275 |
| 2012/0037172 | A1* | 2/2012 | Allen | A24D 3/04 131/275 |
| 2014/0069447 | A1* | 3/2014 | Bailey | A24D 3/041 131/337 |

FOREIGN PATENT DOCUMENTS

| | | |
|---|---|---|
| CN | 101203148 | 6/2008 |
| CN | 101443140 | 5/2009 |
| CN | 101969797 | 2/2011 |
| CN | 101977521 | 2/2011 |
| CN | 102046033 | 5/2011 |
| CN | 102657380 | 9/2012 |
| CN | 102834027 | 12/2012 |
| CN | 102892316 | 1/2013 |
| CN | 102906925 | 1/2013 |
| CN | 102933105 | 2/2013 |
| EP | 0 920 816 | 6/1999 |
| EP | 2554060 | 2/2013 |
| EP | 2578093 | 4/2013 |
| EP | 2537427 | 8/2016 |
| GB | 2395650 | 9/2005 |
| JP | S64-60363 | 3/1989 |
| JP | 11-147708 | 6/1999 |
| JP | 2001-152025 | 6/2001 |
| JP | 2005-525795 | 9/2005 |
| JP | 2010-505423 | 2/2010 |
| JP | 2010-514437 | 5/2010 |
| JP | 2013-526266 | 6/2013 |
| KZ | 25499 | 2/2012 |
| KZ | 27534 | 10/2013 |
| WO | WO 2006/117697 | 11/2006 |
| WO | WO 2008/084333 | 7/2008 |
| WO | WO 2009/143338 | 11/2009 |
| WO | WO 2010/103323 | 9/2010 |
| WO | WO 2011/116236 | 9/2011 |
| WO | WO 2011/140430 | 11/2011 |
| WO | WO 2013/011312 | 1/2013 |
| WO | WO 2013/017624 | 2/2013 |
| WO | WO 2013/020280 | 2/2013 |
| WO | WO 2013/187245 | 12/2013 |

OTHER PUBLICATIONS

PCT Search Report and Written Opinion for PCT/EP2014/078454 dated Apr. 30, 2015 (7 pages).
European Extended Search Report for Application No. 13198919.6 dated Jul. 9, 2014 (4 pages).
Notice of Allowance issued in Kazakhstan for Application No. 2016/0633.1 dated Sep. 19, 2016 (8 pages). English translation included.
Press Release, American Tobacco, Apr. 22, 1968.
Press Release, American Tobacco, Sep. 11, 1967.
"Filter Rod Specifications", Apr. 22, 1968.
"History of the Development of the Convertible Cigarette", May 28, 1968.
"The Development of the Convertible Cigarette", May 28, 1968.
"Progress Report", Apr. 9, 1968.
"Weekly Report of New Product Division", Feb. 1, 1968.
Office Action issued in Taiwan for Application No. 103144220 dated May 30, 2018 (19 pages). English translation included.
Inagaki et al., "Pore Size Distribution and Adsorption Selectivity of Sepiolite", Clay Minerals, 1990, 25, pp. 99-105.
Operation Manual for Alluris Force Gauges, 84 pages.
ASTM D3802-16, Standard Test Method for Ball-Pan Hardness of Activated Carbon, 4 pages.
BPL 4x6 Data Sheet, CalgonCarbon, 1 page.
BPL 4x10 Data Sheet, CalgonCarbon, 1 page.
Galan E., "Properties and Applications of Palygorskite-Sepiolite Clays", Clay Minerals, 1996, 31, pp. 443-453.
Office Action issued in Japan for Application No. 2016-534234 dated Dec. 13, 2018 (18 pages). English translation included.
Office Action issued in China for Application No. 201480065478.0 dated Jan. 2, 2019 (19 pages). English translation included.
Office Action issued in China for Application No. 201480065478.0 dated Aug. 29, 2019 (7 pages). English translation included.
Office Action issued in Brazil for Application No. 112016011480-9 dated Nov. 26, 2019 (5 pages). English translation included.
Rathke, et al., "A Critical Analysis of the Hydrino Model", New Journal of Physics, (2005), vol. 7, No. 10, 10 pages.
European Decision after Hearing for Appeal for Application No. 14812757.4 dated Oct. 14, 2020 (46 pages).
European Summons to Attend Oral Proceedings for Application No. 14812757.4 dated Jul. 20, 2020 (8 pages).
European Summons to Attend Oral Proceedings for Application No. 14812757.4 dated Apr. 29, 2019 (13 pages).
Office Action issued in China for Application No. 201911105857.9 dated Mar. 24, 2021 (18 pages). English translation included.

* cited by examiner

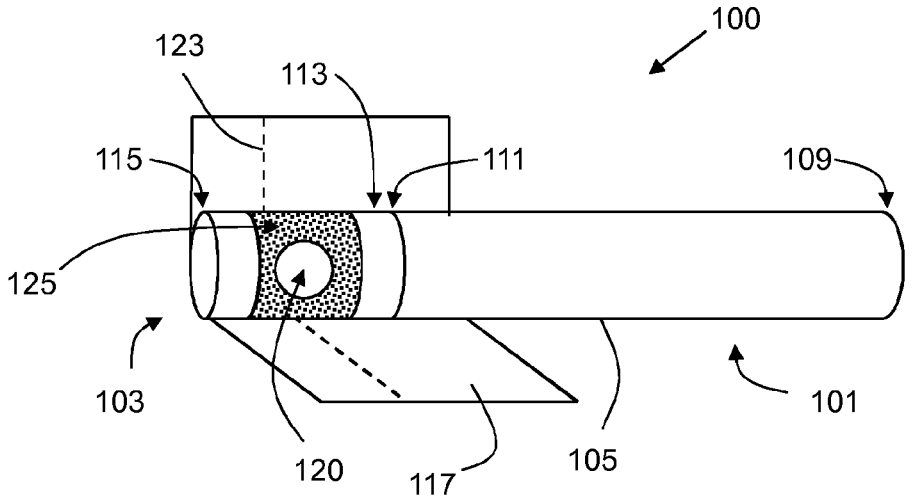
100
123
113
115
111
109
125
103
101
120
117
105

SMOKING ARTICLE HAVING A FILTER INCLUDING A CAPSULE

This application is a U.S. National Stage Application of International Application No. PCT/EP2014/078454, filed Dec. 18, 2014, which was published in English on Jun. 25, 2015, as International Patent Publication WO 2015/091792 A1. International Application No. PCT/EP2014/078454 claims priority to European Application No. 13198919.6 filed Dec. 20, 2013.

The present invention relates to a filter including a capsule in a cavity and to a smoking article having a mouthpiece incorporating such a capsule in a cavity.

Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

It is known to incorporate flavourant additives into smoking articles in order to provide additional flavours to the consumer during smoking. Flavourants may be used to enhance the tobacco flavours produced upon heating or combusting the tobacco material within the smoking article, or to provide additional non-tobacco flavours such as mint or menthol.

The flavourant additives used in smoking articles, such as menthol, are commonly in the form of a liquid flavourant which is incorporated into the filter or the tobacco rod of the smoking article using a suitable liquid carrier. Liquid flavourants are often volatile and will therefore tend to migrate or evaporate from the smoking article during storage. The amount of flavourant available to flavour the mainstream smoke during smoking is therefore reduced.

It has previously been proposed to reduce the loss of volatile flavourants from smoking articles during storage through the encapsulation of the flavourant, for example, in the form of a capsule or microcapsule. The encapsulated flavourant can be released prior to or during smoking of the smoking article by breaking open the encapsulating structure, for example by crushing or melting the structure. Where such capsules are crushed to release the flavourant, the capsules break open at a particular force and release all of the flavourant at that force.

In many smoking articles incorporating a capsule, the capsule will be provided within a segment of fibrous filtration material, such as cellulose acetate tow. With this arrangement, the force that the consumer needs to apply to the filter in order to break the capsule is typically higher than the crush strength of the capsule, which is the force required to break the capsule when it is outside of the filter. In order to facilitate the release of the flavourant by the consumer it is desirable to use a capsule with a relatively low crush strength. However, the use of easily breakable capsules may be undesirable from a manufacturing perspective, since the capsules may be unable to withstand the forces to which they will be subjected during manufacture of the smoking articles incorporating the capsule.

It would therefore be desirable to provide a novel filter arrangement incorporating a breakable capsule of a flavourant, in which the capsule can be more readily crushed by the consumer, whilst minimizing the risk of the capsule inadvertently breaking during manufacture and normal handling of the smoking article.

According to a first aspect of the present invention, there is provided a smoking article having an aerosol generating substrate and a mouthpiece. The mouthpiece includes a cavity at least partially filled with a particulate material and contains at least one breakable capsule of a liquid flavourant at least partially surrounded by the particulate material, such that the force required to break the capsule within the mouthpiece to release the liquid flavourant is less than three times the inherent burst strength of the capsule.

According to a second aspect of the present invention, there is provided a filter for a smoking article, the filter comprising a cavity at least partially filled with a particulate material and containing at least one breakable capsule of a liquid flavourant at least partially surrounded by the particulate material, such that the force required to break the capsule within the mouthpiece to release the liquid flavourant is less than three times the inherent burst strength of the capsule. The inherent burst strength of the capsule is the burst strength of the capsule when not in contact with the particulate material and outside of a smoking article.

The provision of the particulate material around the capsule makes it easier for the consumer to rupture the capsule by lowering the force required to break it compared to when the capsule is outside of the filter (or compared to when the capsule is embedded in CA tow). The arrangement enables a capsule of a relatively high inherent burst strength to be used whilst keeping the force required to break the capsule at a low level. The capsule is therefore easily breakable by the consumer, but strong enough to effectively withstand the forces during manufacture. The inclusion of the particulate material therefore enables a capsule having a higher inherent burst strength to be used than when the capsule is provided on tow. As discussed in more detail below, the properties of the particulate material and the capsule can be selected to tailor the effect of the particulate material in crushing the capsule or affect how the particulate material interacts with the flavourant of the capsule, once the capsule has been crushed, or both.

Preferably, the force required to break the capsule in the mouthpiece is less than about 50 Newtons, more preferably less than about 40 Newtons, even more preferably less than about 30 Newtons. Preferably, the force required to break the capsule in the mouthpiece is at least about 15 Newtons, more preferably at least about 20 Newtons. In some preferred embodiments, the force required to break the capsule in the mouthpiece is between about 15 Newtons and about 50

Newtons, preferably between about 20 Newtons and about 50 Newtons, more preferably between about 25 Newtons and about 40 Newtons.

Alternatively or additionally, the capsule may have an inherent burst strength of at least 10 Newtons, preferably at least about 20 Newtons, more preferably at least about 25 Newtons. In some embodiments of the current invention, the capsule may be a higher burst strength capsule, for example with an inherent burst strength of at least about 30 Newtons.

Alternatively, or additionally, the capsule preferably has an inherent burst strength of less than about 40 Newtons, more preferably less than about 30 Newtons. The capsule preferably has an inherent burst strength between about 10 Newtons and about 40 Newtons and more preferably between about 10 Newtons and about 30 Newtons, most preferably between about 15 Newtons and about 30 Newtons.

In some embodiments, the inherent burst strength of the capsule is between about 10 Newtons and about 40 Newtons, the force required to break the capsule in the mouthpiece is between about 15 Newtons and about 50 Newtons, and the force required to break the capsule in the mouthpiece is less than about three times the inherent burst strength of the capsule, more preferably less than about two times the inherent burst strength of the capsule.

Preferably, the particulate material has a mean average particle size, which is smaller than the maximum diameter of the capsule. It is particularly preferable that this mean average particle size is at least about two times smaller than the maximum diameter of the capsule, and even more preferable, that the mean average particle size is at least about three times smaller than the maximum diameter of the capsule. Such smaller particle sizes help to reduce the contact area between the surface of the capsule and any one particle, and therefore allow for the force applied to the capsule from that particle to be more directly concentrated on a particular area of the capsule. This can improve the likelihood of the capsule rupturing with a lower required force when a consumer applies a crushing force to the filter or mouthpiece.

Preferably, the particles of the particulate material have a mesh size of at least about 10 mesh. Below such a mesh size the contact area between the surface of the capsule and any one particle can become undesirably high, such that the force applied to the capsule from that particle is too widely spread over the surface of the capsule. This can result in a less effective transfer of force from the consumer's fingers to the capsule.

Preferably, the particles of the particulate material have a number average mesh size of no more than about 30 mesh. If the mean average particle size was above about 30 mesh, the particulate material could be comparable to a fine powder. In such an arrangement, the capsule would be more free to move around the cavity and therefore less easy to apply a force to. Furthermore, if the mean average particle size was above about 30 mesh, there is little free space within the cavity for smoke to travel through. This can result in the cavity segment providing an undesirably high resistance to draw (RTD).

Accordingly, in preferred embodiments, at least 95% of the particles of the particulate material have a mesh size of between about 10 and about 30 mesh, more preferably between about 12 and about 20 mesh. Above such ranges of mesh sizes, the particulate material is less effective at transferring a crushing force from a consumer to a capsule. Below such ranges of mesh sizes, the particulate material tends to act more like a powder.

The particles of the particulate material may have any suitable shape. However, preferably the particles of the particulate material have an irregular or non-spherical shape. That is, preferably a plurality of the particles of the particulate material have a sphericity value of less than about 0.8, more preferably a sphericity value of less than about 0.6, most preferably less than about 0.6. Sphericity is a measure of how spherical (or non-spherical) an object is. By definition, the sphericity ($\Psi$) of an object is the ratio of the surface area of a sphere having the same volume as the given object to the surface area of the object, as expressed by the formula given below:

$$\Psi = \frac{\pi^{\frac{1}{3}}(6V_p)^{\frac{2}{3}}}{A_p}$$

Accordingly, a perfect sphere has a sphericity value of 1.

By having an irregular or non-spherical shape the contact area between the surface of the capsule and any one particle can be minimized, and therefore the force applied to the capsule from that particle can be more directly concentrated on a particular area of the capsule. This can improve the likelihood of the capsule rupturing when a consumer applies a crushing force to the filter or mouthpiece.

Preferably, the particulate material has a ball pan hardness of at least about 80%, more preferably at least about 90%. Particulate materials having such hardness can help to reduce the force required to break the capsule, since the force from the consumer is more directly transferred to the capsule, rather than absorbed in or dispersed by the surrounding material (as with cellulose acetate tow).

Preferably, the particulate material has a bulk density of at least about 0.3 g/cm$^3$. More preferably, the particulate material has a bulk density less than about 0.9 g/cm$^3$. In some preferred embodiments, the particulate material has a bulk density of between about 0.4 and about 0.7 g/cm$^3$, even more preferably between about 0.45 and about 0.55 g/cm$^3$. Such bulk densities are significantly higher than that typically associated with standard cellulose acetate tow (0.15 g/cm$^3$), and provide a material which is more effective at directly transferring a crushing force from a consumer's fingers to the capsule.

The particulate material may be formed from any suitable material or materials. In some preferred embodiments, the particulate material includes a sorbent material. The term "sorbent" refers to material that captures or converts one or more smoke constituents. Examples of suitable sorbent materials include activated carbon, coated carbon, active aluminium, aluminium oxide, zeolites, sepiolites, molecular sieves, and silica gel. Particularly preferred sorbent materials are activated carbon and zeolites, as these materials typically have desirable hardness, shape and size properties for effectively transferring the crushing force from a consumer's fingers to the capsule.

Where the particulate material includes a sorbent material, the properties of the sorbent material can be adjusted to maximize the effect of the sorbent material in crushing the capsule and/or affect how the sorbent material interacts with the flavourant of the capsule, once the capsule has been crushed. For example, the porosity of sorbent can be selected in order to tailor the sorption of flavourant by the particulate sorbent material. In particular, in some embodiments, it may be desirable to select a sorbent having a suitable pore size distribution that could result in flavourant, which has been released from the capsule being temporarily trapped in the sorbent, but then subsequently released from the sorbent at a later stage of the smoking cycle. Without wishing to be bound by theory, it is thought that this could result in a more gradual release of flavourant throughout the duration of smoking of the smoking article.

Accordingly, it is preferable that at least about 30% of the total pore volume of the sorbent material is provided by pore sizes in the range of about 2 nm to about 50 nm, and more preferably in the range of about 10 nm to about 50 nm. In some embodiments, more than about 50% of the total pore volume of the sorbent material is provided by pore sizes in the range of about 2 nm to about 50 nm, more preferably in the range of about 10 nm to about 50 nm. Without wishing to be bound by theory, it is thought that such pore size distributions could result in a more gradual release of flavourant throughout the duration of smoking of the smoking article. Alternatively or additionally, the sorbent material preferably has a BET surface area of less than about 1500, more preferably less than about 1000, and even more preferably less than about 350 square metres per gram. Preferably, the sorbent material has a BET surface area of at least about 200.

The particulate material may alternatively or additionally include a non-sorbent material, which is a material not typically referred to as a sorbent. For example, the particulate material may include precipitated calcium carbonate or agglomerated plant particles, such as agglomerated mint granules or lemon myrtle granules. Such particles will typically have irregular shapes and can therefore be particularly effective at transferring the crushing force from the consumer's fingers to the capsule, and the non-sorbent properties prevent the particulate material from absorbing large amounts of the material that is released from the capsule.

Preferably, the cavity has a length, in the longitudinal direction of the mouthpiece, of at least about 1.5 mm greater than maximum dimension of the capsule, more preferably at least 2 mm greater. Preferably, the cavity has a length, in the longitudinal direction of the mouthpiece, that is less than about 12 mm greater than maximum dimension of the capsule, more preferably less than about 7 mm greater. Such a cavity size can allow the capsule to be fully, and more evenly, surrounded by the particulate material. This can provide a more even distribution of the force around the capsule, and can also ensure that a crushing force is effectively transferred to the capsule, regardless of where the consumer locates their fingertips on the filter or mouthpiece.

The cavity is at least partially filled with particulate material, so that the crushing force from a consumer's fingers can be more effectively transferred to the capsule. This allows the force required to break the capsule in the filter to be less than three times the inherent burst strength of the capsule. To enhance the effectiveness of this, preferably the particulate material occupies at least 60% of the space in the cavity that is not already occupied by the capsule. More preferably, the particulate material occupies at least 80% of the space in the cavity that is not already occupied by the capsule, and even more preferably, the particulate material occupies at least 90% of the space in the cavity that is not already occupied by the capsule. Such high percentage fills can ensure that a crushing force is effectively transferred to the capsule, regardless of where the consumer locates their fingertips on the filter or mouthpiece.

Preferably, the capsule includes an outer shell encapsulating a liquid, most preferably a liquid flavourant. Preferably the outer shell has a thickness of at least 30 microns, more preferably at least 50 microns to provide an inherent burst strength that is sufficiently high that the capsule can withstand forces during manufacture. The shell may be formed of any suitable material, such as a hydrocolloid selected from gellan gum, agar, carrageenans, pullulan gum or modified starch, alone or as a mixture thereof or in combination with gelatin.

The capsule may be formed in a variety of physical formations including, but not limited to, a single-part capsule, a multi-part capsule, a single-walled capsule, a multi-walled capsule, a large capsule, and a small capsule.

The capsule may have any suitable shape, such as spherical, oval or cylindrical. However, preferably the capsule is spherical. This may include capsules having a sphericity value of at least about 0.9, and preferably a sphericity value of approximately 1. Sphericity is a measure of how spherical an object is. By definition, the sphericity ($\Psi$) of an object is the ratio of the surface area of a sphere having the same volume as the given object to the surface area of the object, as expressed by the formula given below:

$$\Psi = \frac{\pi^{\frac{1}{3}}(6V_p)^{\frac{2}{3}}}{A_p}$$

Accordingly, a perfect sphere has a sphericity value of 1. Preferably, the generally spherical capsule comprises a generally spherical outer shell.

The liquid flavourant of the capsule may contain any suitable flavourant. Suitable flavourants include natural or synthetic menthol, peppermint, spearmint, coffee, tea, spices (such as cinnamon, clove and/or ginger), cocoa, vanilla, fruit flavours, chocolate, eucalyptus, geranium, eugenol, agave, juniper, anethole, linalool, and any combination thereof. A particularly preferred flavourant is menthol.

The capsule preferably has a diameter of between about 2 mm and about 7 mm, more preferably between about 3 mm and about 5 mm. In some preferred embodiments, the capsule has a diameter of about 3.5 mm.

The capsule may have any suitable inherent burst strength. For example, the capsule may have an inherent burst strength of between about 10 Newtons and about 25 Newtons. Such capsules are known to have adequately high inherent burst strengths such that they will normally withstand the forces to which they will be subjected during manufacture of the smoking articles incorporating the capsule. However, in some embodiments, it is preferable to use a capsule having an even higher inherent burst strength than this. In particular, it may be preferable to use a capsule having an inherent burst strength of at least about 25 Newtons, more preferably at least about 30 Newtons. Such capsules are even more robust than those typically used in smoking article filters, and are therefore even more capable of resisting breakage during manufacture of the smoking articles. Such 'high-burst strength capsules' would not typically have been considered suitable because they would be too hard for a consumer to break when in the filter or mouthpiece. Nevertheless, the arrangement of the present invention would allow for use of such capsules. For example, in some embodiments, capsules having an inherent burst strength of at least about 25 Newtons, and more preferably at least about 30 Newtons, can be used in a filter in which the force required to break the capsule within the mouthpiece is less than about 50 Newtons.

To determine whether a capsule containing mouthpiece or smoking article falls within the scope of the present invention, an appropriate number, such as 20, of identically designed smoking articles or mouthpieces should be obtained. The capsules in half of these samples should be carefully removed, in a manner that minimizes any change in state of the capsule. The inherent burst strength of these capsules should then be determined using a suitable measuring device known in the art, such as an Alluris type FMI—220 C2—digital force gauge 0-200N (commercially available from Alluris Gmbh & Co .KG, Germany). The remaining half of the samples (in other words, those with the capsules still within the mouthpiece), should then be subjected to the same test, with any force applying surfaces being applied to the cavity region of the mouthpiece or smoking article that contains the capsule. The inherent burst strength of a capsule or the force required to break a capsule within a mouthpiece is indicated by a peak in the force versus compression curve. The respective measured values for the inherent burst strength of the capsule and the force required to break the capsule within the mouthpiece should then be averaged across the sample sets and the results compared. This testing is conducted at approximately 22 C and 60% relative humidity.

The filter may have any suitable construction. However, preferably the filter is a plug-space-plug filter with an upstream segment and a downstream segment defining the cavity containing the particulate material and the capsule between them. The upstream and downstream segments may each include sorbent and/or flavourant material.

In some embodiments, the filter includes a transparent wrapper which provides a window overlying the cavity. This can allow a consumer to see the particulate material in the cavity. This can be particularly advantageous where the liquid flavourant has a colour or other visual indicator, which would allow a consumer to establish that the capsule has been broken.

The smoking article and filter of the present invention may be produced using existing techniques with minimal modification to existing cavity filling equipment needed. In particular, the cavity may be produced on existing cavity filling equipment which has been modified to have three stages. In the first stage, the cavity space is at least partially filled with a portion, such as 50%, of the particulate material to be used. In the second stage, the capsule is placed on top of the portion of the particulate material occupying the cavity. In the third stage, the remaining portion, such as 50%, of the particulate material is placed on top of the capsule, and then the filter is circumscribed with a wrapper to form the cavity.

Filters according to the disclosure can be attached to a tobacco rod to form all or at least part of a smoking article. Preferably, the filter is axially aligned with the tobacco rod. In many embodiments, the filter is joined to the tobacco rod with tipping paper.

In some embodiments, the smoking article is a conventional cigarette in which the aerosol generating substrate is provided in the form of a cylindrical tobacco rod, and in which the mouthpiece includes a filter.

The features described above in relation to one aspect of the invention may also be applicable to another aspect of the invention.

Although the invention has been described above in relation to the use of a capsule in a cavity containing particulate material, it will be appreciated that the invention is also applicable to smoking articles and filters containing more than one capsule in the cavity which contains the particulate material. The cavity of the invention may therefore include two or more capsules.

The terms "upstream" and "downstream" refer to relative positions of elements of the smoking article or filter described in relation to the direction of mainstream smoke as it is drawn from the aerosol generating substrate and through the filter or mouthpiece.

The term "particle size" refers to the largest cross sectional dimension of an individual particle within the particulate material. The "average" particle size refers to the arithmetic mean particle size for the particles. The particle size distribution for a sample of particulate material may be determined using a known sieve test, such as the standard Test Method described in ASTM D6913-04 (2009).

The term 'burst strength' refers to the force exerted on the capsule (when it is the outside of the smoking article) at which the capsule will burst. The burst strength is indicated by a peak in the capsule's force versus compression curve. This may be tested by using a suitable measuring device known in the art, such as an Alluris type FMI—220 C2—digital force gauge 0-200N (commercially available from Alluris Gmbh & Co .KG, Germany).

The term 'diameter of the capsule' refers to the longest cross-sectional dimension of the capsule when measured perpendicular to the longitudinal direction of the filter or smoking article.

The hardness of the particulate material can be determined using the Standard Test Method for Ball-Pan Hardness described in ASTM D3802. Although this test is described specifically in terms of the hardness of activated carbon, it may also be used for any other suitable particulate material.

The BET surface area of a sorbent material can be determined using the Standard Test Method described in ASTM D1993-03 (2008).

The invention will be further described, by way of example only, with reference to the accompanying drawings in which:

FIG. 1 shows a longitudinal cross section of a smoking article according to the described embodiment.

FIG. 1 is a perspective view of a smoking article 100 according to an embodiment of the invention. The smoking article 100 includes an aerosol forming substrate in the form of a generally cylindrical tobacco rod 101 and a mouthpiece in the form of a generally cylindrical filter 103. The tobacco rod 101 and filter 103 are axially aligned in an end-to-end relationship, preferably abutting one another. The tobacco rod 101 includes an outer wrapper 105 circumscribing the smoking material. The tobacco is preferably a shredded tobacco or tobacco cut filler. The filter 103 includes a filter wrapper (not shown) circumscribing the filter material. The tobacco rod 101 has an upstream, lit end 109 and a downstream end 111. The filter 103 has an upstream end 113 and a downstream, mouth end 115. The upstream end 113 of the filter 103 is adjacent the downstream end 111 of the tobacco rod 101. A breakable capsule 120 containing a liquid flavourant is disposed in a cavity of the filter 103. The cavity also contains a particulate material 125, in the form of activated carbon granules, which surround the breakable capsule 120. The capsule has a diameter of 3.5 mm and the cavity has a length of 5 mm along the longitudinal axis of the filter.

The filter 103 is attached to the tobacco rod 101 by tipping material 117 which circumscribes the entire length of the filter 103 and an adjacent region of the tobacco rod 101. The tipping material 117 is shown partially removed from the smoking article in FIG. 1, for clarity. In this embodiment, the tipping material 117 also includes a circumferential row of perforations 123. The perforations 123 are provided for ventilation of the mainstream smoke.

EXAMPLES

Two capsule containing filters were prepared and tested. The first filter (Sample A) was a standard capsule containing filter, in which a 3.5 mm diameter capsule was embedded within a single segment of cellulose acetate tow. The second filter (Sample B) was a filter in accordance with the present invention. That is, the second filter had a plug-space-plug construction with an 11 mm long upstream segment of cellulose acetate tow and an 11 mm long downstream segment of cellulose acetate tow defining a 5 mm wide cavity between them. The cavity contained a 3.5 mm diameter capsule surrounded by 70 mg of activated carbon particles. The activated carbon particles had a mesh size of 12 to 20 mesh. The filters of both samples were circumscribed with an 80 microns thick filter wrapper and a 40 micron thick tipping paper. The tipping paper was coated on its inner surface with a layer of nitrocellulose to prevent the liquid from the capsule from migrating to the outer surface of the filter. In both samples, the 3.5 mm diameter capsules had a burst strength of approximately 15 Newtons.

An Alluris type FMI—220 C2—digital force gauge 0-200N device (commercially available from Alluris Gmbh & Co. KG, Germany) was used to apply a gradually increasing force to the capsule containing region of both filters, and record the force at which the capsule would break. In sample A, the capsule was found to break in the filter after a force of 45 Newtons had been applied to the filter. In sample B, the capsule was found to break in the filter after a force of 22 Newtons had been applied to the filter.

The invention claimed is:

1. A smoking article comprising:

an aerosol generating substrate; and a mouthpiece comprising a cavity at least partially filled with a particulate material and containing a breakable capsule of a liquid flavourant at least partially surrounded by the particulate material, wherein the particulate material comprises at least one sorbent material and wherein the force required to break the capsule within the mouthpiece to release the liquid flavourant is less than three times the inherent burst strength of the capsule, wherein the hardness of the particulate material is at least 90% when measured in a Ball Pan Hardness test conducted in accordance with ASTM D3802 and wherein the at least one sorbent material has a total pore volume, and at least 30 percent of the total pore volume of the sorbent material is provided by pore sizes in the range of about 2 nm to about 50 nm, wherein the particulate material has a mean average particle size that is at least three times smaller than a maximum diameter of the breakable capsule, and wherein the particulate material occupies at least 60% of the space in the cavity that is not occupied by the capsule.

2. A smoking article according to claim 1, wherein the breakable capsule has an inherent burst strength of at least 10 Newtons.

3. A smoking article according to claim 1, wherein the breakable capsule has an inherent burst strength of at least 25 Newtons.

4. A smoking article according to claim 1, wherein the force required to break the capsule within the mouthpiece to release the liquid flavourant is less than 50 Newtons.

5. A smoking article according to claim 1, wherein the particulate material has a mesh size such that at least 95% of the particles fall between 12 and 20 mesh.

6. A smoking article according to claim 5, wherein the capsule has a diameter of between 3 millimeters and 5 millimeters.

7. A smoking article according to claim 1, wherein the BET surface area of the at least one sorbent material is less than 1500 square metres per gram.

8. A smoking article according to claim 1, wherein the particulate material has a bulk density of at least 0.3 grams per cubic centimeter.

9. A smoking article according to claim 1, wherein the length of the cavity, in the longitudinal direction of the mouthpiece, is at least about 1.5 mm greater than the maximum diameter of the breakable capsule.

10. A smoking article according to claim 1, wherein the breakable capsule comprises an outer shell encapsulating the liquid flavourant, wherein the outer shell has a thickness of at least 30 microns.

11. A smoking article according to claim 1, wherein the mouthpiece comprises a mouth end filter segment and a rod end filter segment, wherein the cavity is defined between the mouth end filter segment and the rod end filter segment.

12. A filter for a smoking article, the filter comprising a cavity at least partially filled with a particulate material and containing a breakable capsule of a liquid flavourant at least partially surrounded by the particulate material, wherein the particulate material comprises at least one sorbent material and wherein the force required to break the capsule within the filter to release the liquid flavourant is less than three times the inherent burst strength of the capsule, wherein the hardness of the particulate material is at least 90% when measured in a Ball Pan Hardness test conducted in accordance with ASTM D3802 and wherein the at least one sorbent material has a total pore volume, and at least 30 percent of the total pore volume of the sorbent material is provided by pore sizes in the range of about 2 nm to about 50 nm, wherein the particulate material has a mean average particle size that is at least three times smaller than a maximum diameter of the breakable capsule, and wherein the particulate material occupies at least 60% of the space in the cavity that is not occupied by the capsule.

13. A smoking article comprising:

an aerosol generating substrate; and a mouthpiece comprising a cavity at least partially filled with a particulate material and containing a breakable capsule of a liquid flavourant at least partially surrounded by the particulate material, wherein the particulate material comprises at least one sorbent material and wherein the force required to break the capsule within the mouthpiece to release the liquid flavourant is less than three times the inherent burst strength of the capsule, wherein the particulate material has a mesh size such that at least 95% of the particles fall between 12 and 20 mesh, wherein the particulate material has a mean average particle size that is at least three times smaller than a maximum diameter of the breakable capsule, wherein the hardness of the particulate material is at least 90% when measured in a Ball Pan Hardness test conducted in accordance with ASTM D3802, wherein the at least one sorbent material has a total pore volume, and at least 30 percent of the total pore volume of the sorbent material is provided by pore sizes in the range of about 2 nm to about 50 nm, wherein the particulate material occupies at least 60% of the space in the cavity that is not occupied by the capsule and wherein the breakable capsule comprises an outer shell encapsulating the liquid flavourant, wherein the outer shell has a thickness of at least 30 microns.

14. A smoking article according to claim 13, wherein the capsule has a diameter of between 3 millimeters and 5 millimeters.

* * * * *